US005493482A

United States Patent [19]

Bowen

[11] Patent Number: 5,493,482

[45] Date of Patent: Feb. 20, 1996

[54] ENHANCED PORTABLE FLUORESCENT WORK LIGHT

[76] Inventor: Donald A. Bowen, 32 Bradford St., Apt. 2, Concord, Mass. 01742

[21] Appl. No.: 249,960

[22] Filed: May 27, 1994

[51] Int. Cl.[6] ..... F21L 3/00

[52] U.S. Cl. ..... 362/260; 362/219; 362/223; 362/225

[58] Field of Search ..... 362/217, 219, 362/221, 223, 225, 226, 260, 267, 457

[56] References Cited

U.S. PATENT DOCUMENTS

| | | | |
|---|---|---|---|
| 3,805,053 | 4/1974 | Julinot | 362/223 |
| 4,092,706 | 5/1978 | Vest | 362/223 |
| 4,800,473 | 1/1989 | Tremblay | 362/217 |
| 4,947,475 | 8/1990 | Bright | 362/225 |
| 5,088,015 | 2/1992 | Baggio et al. | 362/217 |
| 5,257,172 | 10/1993 | Erickson | 362/226 |

FOREIGN PATENT DOCUMENTS

| | | | |
|---|---|---|---|
| 1538568 | 7/1969 | France | 362/217 |
| 311065 | 5/1929 | United Kingdom | 362/223 |

*Primary Examiner*—Ira S. Lazarus
*Assistant Examiner*—Y. Quach

[57] ABSTRACT

The subject invention is a portable, multiple lamp, fluorescent work light encased in a durable, light-weight tubular case employing resilient end caps. The tubular shell and the resilient end caps, when tied together with a single structural rod, form a strong, durable structure which can be opened by unscrewing just one external nut. The resilient end caps combine three different functions in one item such that weight, size and cost can be reduced. The invention is intended for work or construction sites where a considerable amount of temporary, rugged lighting needs to be deployed rapidly.

21 Claims, 2 Drawing Sheets

ENHANCED PORTABLE FLUORESCENT WORK LIGHT

BRIEF DESCRIPTION

The subject invention is a portable, multiple lamp, fluorescent work light encased in a durable, light-weight tubular case employing resilient end caps. The tubular shell and the resilient end caps, when tied together with a single structural rod, form a strong, durable structure which can be opened by unscrewing just one external nut. The resilient end caps serve the multiple purposes of; I) forming a strong, tight seal between the tubular shell and other external components, II) allowing easy disassembly or assembly of the enhanced portable work light and III) absorbing shocks from falls or other impacts as well as protecting external parts such as a power cord strain relief and power switch from direct impacts. The resilient end caps combine these three features in such a way that the end caps and structure of the invention are durable, light weight and compact. The invention is typically used in work or construction sites where a considerable amount of temporary, rugged lighting needs to be deployed rapidly.

BRIEF DESCRIPTION OF THE DRAWINGS

FIG. 3 also shows how the external disks 5 and 13, resilient end caps 6, structural rod 7, and tubular shell 8 are assembled. Dashed lines indicate the direction of assembly for exterior items. Where a number such as 6 points to two different images, the upper image is a side view, and the lower image is an end view of the same object.

DETAILED DESCRIPTION OF THE INVENTION

Figure 1:
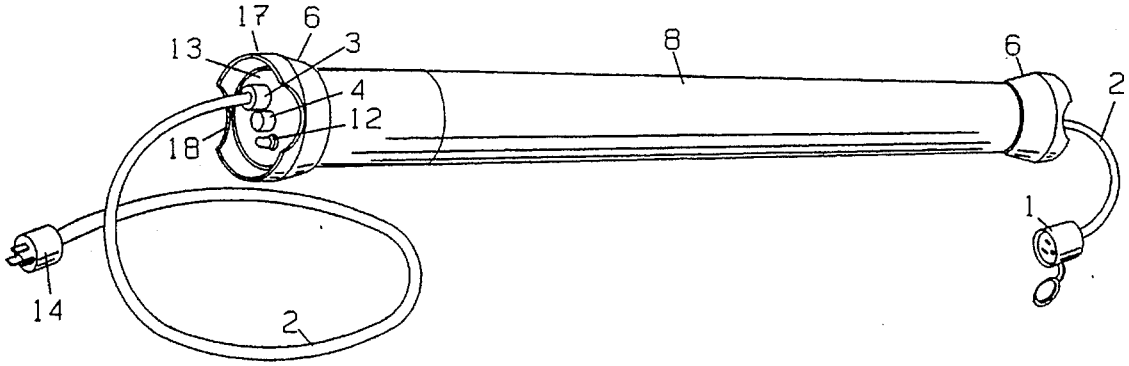
FIG. 1 shows an external view of the enhanced portable work light.

A typical use of the invention would be in a construction or similar type of work environment where the light will be used on a temporary basis or where lights must be moved frequently. A typical application would be inside an airplane during its construction. The invention typically includes a power cord 2 with plug 14 at one end and a power receptacle 1 at the other end such that several enhanced portable work lights can be plugged together to form a string of work lights.

Prior art fluorescent work lights were most commonly a single lamp unit in a clear tubular shell which used the shell as an attachment point to hold the end caps 6 in place. Prior art multiple lamp, fluorescent work lights, capable of similar light Lumen output and impact resistance when compared with the invention, have weighed significantly more.

The invention differs from prior art in that it uses a circular or near circular cross section tubular shell 8 combined with multipurpose resilient end caps 6 which when tied together with a single, hollow structural rod 7 which travels inside the tubular shell 8 between each of the resilient end caps 6, ties the supporting structural components of the light together in a light weight, strong, and durable package. Construction with the single structural rod 7 allows the light to be opened by means of unscrewing only one large nut 4 threaded onto the end of the structural rod. The electrical 9,10,11 and lamp 15 components are connected to the structural rod. The resilient end cap 6, and the way that it is used in the construction of the enhanced portable work light, is unique in that it provides three separate functions in one compact piece. The integration of any two or all three of these functions into one piece provides an additional benefit in reduced weight, material cost, and production cost for the resilient end cap and enhanced portable work light. The three functions provided by the resilient end cap (REC) 6 are:

I) The REC enables a strong, tightly fitting, seal between the external disk and the tubular shell 8 of the enhanced portable work light even though the external disk is smaller in diameter than the inside diameter of the tubular shell. The external disk 5,13 is smaller in diameter than the tubular shell 8 so that the tubular shell may slide over it as well as the rest of the light during assembly or disassembly.

Figure 2:
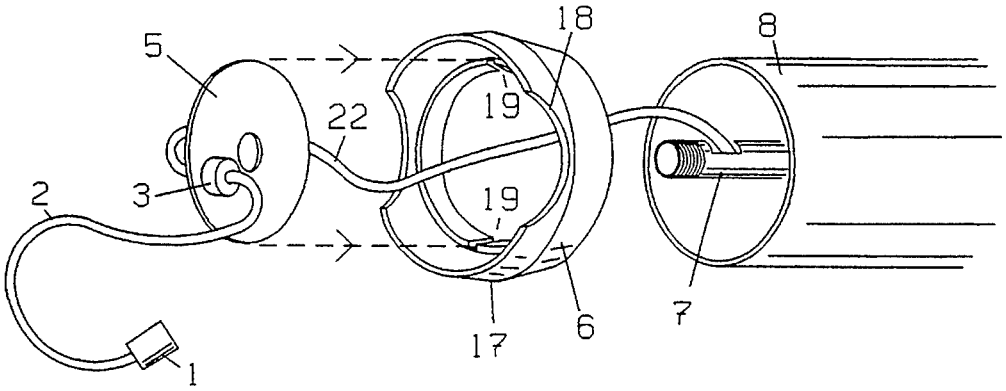
FIG. 2 shows how the resilient end cap 6 can be removed from the enhanced portable work light without disconnecting internal wiring 22, by pushing the external disk 5 through the internal slots 19 of the resilient end cap 6. The external disk 5 is sized smaller than the inside diameter of tubular shell 8 to allow tubular shell 8 to slide past external disk 5 and internal components of the light.
Figure 3:
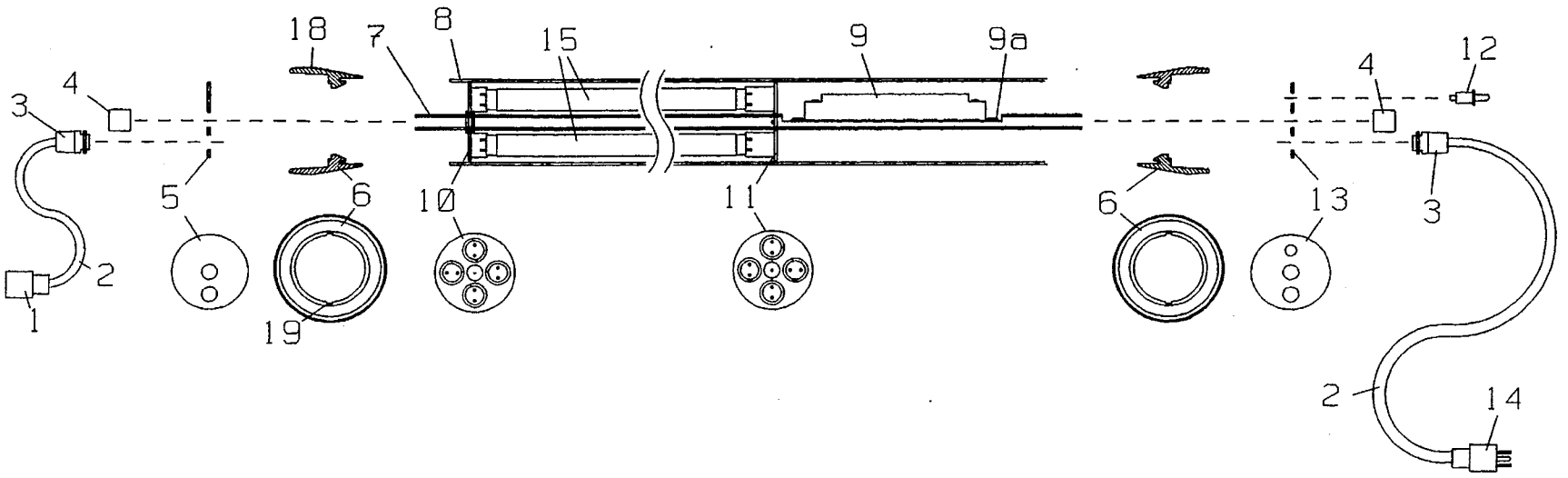
FIG. 3 shows an exploded cross sectional side view of the invention showing major components of the invention's structure.
Figure 4:
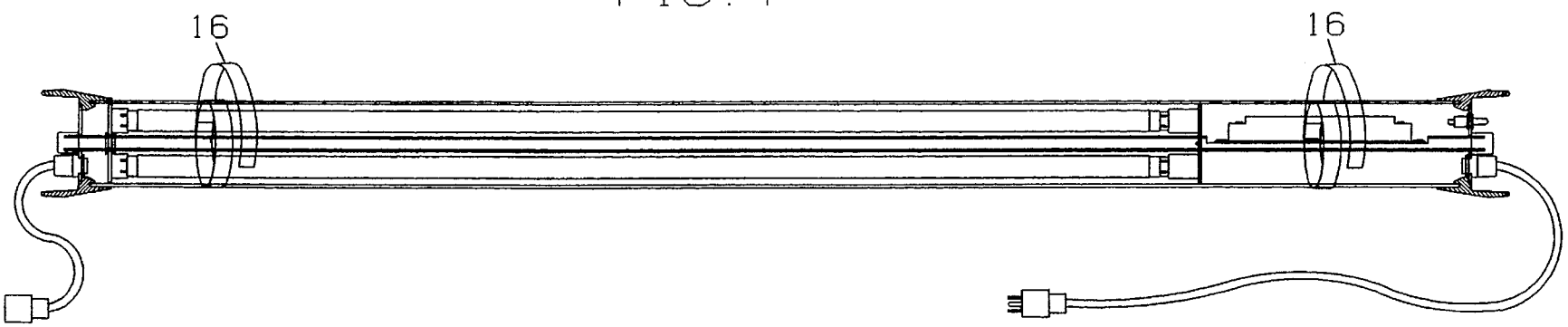
FIG. 4 shows an assembled, cross sectional, side view of the invention.

II) The external disk can be pushed sideways through the inside of the REC through internal slots 19. This feature allows the resilient end cap to be separated from the light without disconnecting internal wiring 22 attached to the external disk. This is accomplished by first loosening and removing the threaded, capped, nut 4 holding the external disk 5, 13 in position, pulling the external disk away from the REC, then flipping the external disk approximately 90 degrees such that its edges line up with internal slots 19 built into the inside of the REC, and finally, pushing the disc through the inside of the REC through internal slots 19 as shown in FIG. 2. The external disk 5, 13 is pushed through the inside of the REC in order to install or remove the REC from the light without disconnecting internal wiring 22 which is connected to the external disk. Since, as described above, the external disk 5, 13 fits inside the tubular shell 8, the tubular shell may slide on or off past the external disk internal components of the light without having to disconnect internal wiring 22 attached to the external disk.

III) The REC has an integral resilient extension 17 which extends or flares radially around and beyond the external disk 5, 13 at the end of the enhanced portable work light in the same way that a skirt would extend or flare around and beyond a person's hip. The purpose of the resilient extension is twofold: first the resilient extension protects components attached to the external disks 5, 13 such as electrical cord strain reliefs 3 or power switches 12 from direct impacts, and secondly the resilient extension 17 serves to cushion the entire enhanced portable work light from impacts whether they are of the type from dropping the enhanced portable work light in a vertical or horizontal orientation. For impacts such as when the enhanced portable work light is dropped in a horizontal orientation, the flaring construction of the resilient extension ensures that the contact point, for an impact with a flat surface such as the floor, will be beyond the end of the tubular shell 8. A contact point at that location will give easier and therefore produce a softer cushioning with a more gradual deceleration, than a contact point closer to the tubular shell such as would happen if the resilient extension did not flare as described above. The above flaring construction therefore enables the REC to provide soft cushioning even when the REC is made of a stiffer or higher durometer material. The advantage of using a stiffer or higher durometer material is that the entire resilient end cap 6 can be constructed with less material to be lighter weight.

The preferred material of construction for the resilient end cap 6 is an elastomer such as polyurethane in a durometer range of between 60 and 120 Shore A.

The preferred plastic, for the tubular shell 8, is clear polycarbonate which has a very high impact strength relative to weight and size, and therefore allows a lighter weight construction. The tubular shell 8 can have grooves etched in it to defuse light. Additionally, tubular shell 8 can have an oval cross section. The preferred structural rod 7 which ties the resilient end caps 6 together is a hollow aluminum rod which is threaded at each end. The threaded portion of the structural rod 7 extends through external disks 5, 13 on each end of the enhanced portable work light. A threaded, capped, nut 4 can thread onto the end of the structural rod 7 compress and seal an external disk 5, 13 against the resilient end cap 6, which in turn presses and seals the resilient end cap 6 against the tubular shell 8 of the enhanced portable work light. By having a single external tightening mechanism at each end cap, the light can be assembled and disassembled rapidly. The hollow rod 7 also carries electrical wires inside it from one end of the light to the other.

The preferred construction of the threaded nut 4 is a capped one made of plastic such that a watertight seal can be made by using an "O" ring between the nut 4 and the external disk 5, 13.

The preferred construction of the invention includes watertight exterior electrical components such as cord strain relief, power plug, power receptacle, and power switch.

One preferred construction for an enhanced portable work light is to use a quantity of four, four foot long fluorescent T8 lamps, spaced evenly around, and parallel to, the structural rod 7. Alternate constructions include 2, 3, 4, or 6 lamps in 2 foot, 3 foot, 4 foot, 5 foot, or 6 foot lengths. Lamps can be either T5, T8, T10, or T12 diameter size, bipin or single pin fluorescent lamps. The bipin sockets are attached to socket disks which are attached to the structural rod 7. To reduce the chance of improper rotation of one socket disk with respect to the other, the socket disks are made such that they are not radially symmetrical.

Another preferred construction of the enhanced portable work light is to use two 22.5 inch long twin-tube compact fluorescent lamps. Alternate constructions include 2, 3, or 4 compact fluorescent bulbs of any length.

A preferred construction is to mount a high efficiency, light-weight electronic solid state fluorescent ballast to the structural support rod 7 beyond the end of the lamps 15. The structural rod is notched to provide a flat surface onto which the ballast is mounted.

A preferred construction is to incorporate a power cord 2 with a plug 14 connected to one end of the enhanced portable work light, and to incorporate a receptacle 1 attached to the other end of the light. The receptacle can be attached to a power cord 2 as well. Matching water tight plugs and receptacles can be used. The receptacle is wired directly to the power cord 2 so that two or more enhanced portable work lights can be plugged together to form a string of work lights.

A preferred construction is to use two Velcro straps 16 to hang the enhanced portable work light which wrap around the light tight enough that straps 16 can not slip past resilient end caps 6, but attached loosely enough so that their position can be adjusted by sliding a strap 16 up or down the length of the tubular shell 8.

A preferred construction is to put two large semicircular notches 18 in the flared extensions 17 on the resilient end cap 6. The notches are intended to decrease the chance of the flared extension landing on and pinching the power cord 2 when the enhanced portable work light is rested on its end in a near vertical orientation.

What is claimed is:

1. A portable work light comprising:

a clear tubular outer shell having a cavity extending along a longitudinal axis with an internal dimension extending transverse said axis;

a resilient end cap enclosing an end of the tubular shell and having an opening passing through the end cap;

a support structure extending longitudinally through the cavity of an tubular shell and having a threaded portion at the end thereof;

lighting components secured to the support structure and positioned within the cavity of the tubular shell;

a plate connected to the support structure by internal wiring extending from the support structure, the plate being positioned over the opening in the end cap and having an opening through which the threaded portion of the structure extends, the plate when disposed in a plane transverse to the longitudinal axis completely covers the opening in the end cap but when disposed in another plane, the plate is capable of being pushed through the opening in the end cap, the plate having a lateral dimension which is larger than the opening in the end cap for forming a water proof seal with the end cap but smaller than the internal dimension of the tubular shell to allow removal of the tubular shell; and a threaded nut for engaging the threaded portion of the support structure for tightening the plate against the end cap and securing the end cap to the end of the tubular shell.

2. The portable work light of claim 1 in which the lighting components comprise one or more fluorescent lamps spaced around, and parallel to, the structural rod.

3. The portable work light of claim 2 further comprising a fluorescent ballast attached to the support structure adjacent to the fluorescent lamps.

4. The portable work light of claim 3 whereby the fluorescent ballast is a solid state electronic fluorescent ballast.

5. The portable work light of claim 2 in which the fluorescent lamps are multiple bipin fluorescent lamps which are spaced evenly around the support structure.

6. The portable work light of claim 2 in which the fluorescent lamps are compact fluorescent lamps.

7. The portable work light of claim 1 whereby the clear tubular shell has a circular cross section.

8. The portable work light of claim 1 further comprising a power cord and plug attached to one end of the light, and a power receptacle attached to the other end of the light.

9. The portable work light of claim 8 whereby the plug and receptacle are watertight.

10. The portable work light of claim 1 further comprising an integral power switch secured to the light.

11. The portable work light of claim 1 whereby electrical wires are carried within the support structure.

12. The portable work light of claim 1 whereby the threaded nut is a capped nut which in combination with an "O" ring provides a liquid tight seal between the nut and the plate.

13. The portable work light of claim 1 whereby all external surfaces of the light are non-metallic.

14. The portable work light of claim 1 whereby the support structure is notched to provide a flat surface onto which a fluorescent ballast can be mounted.

15. The portable work light of claim 1 further comprising adjustable straps attached around the tubular shell.

16. The portable work light of claim 1 in which the plate is a circular disk.

17. The portable work light of claim 16 in which the opening in the end cap includes a pair of internal slots positioned opposite to each other.

18. The work light of claim 1 in which the resilient end cap includes a hollow flange which extends away from the tubular shell and flares radially outward from the tubular shell.

19. The resilient end cap of claim 18 in which the flange is notched.

20. A portable work light comprising:

a clear tubular outer shell having a cavity extending along a longitudinal axis with an internal dimension extending transverse said axis;

a resilient end cap enclosing an end of the tubular shell and having an opening passing through the end cap, the opening including a pair of internal slots positioned opposite to each other;

a support structure extending longitudinally through the cavity of the tubular shell and having a threaded portion at an end thereof;

lighting components secured to the support structure positioned within the cavity of the tubular shell;

a plate comprising a circular disk connected to the support structure by internal wiring extending from the support structure, the plate being positioned over the opening in the end cap and having an opening through which the threaded portion of the support structure extends, the plate when disposed in a plane transverse to the longitudinal axis completely covers the opening in the end cap but when disposed in another plane, the plate is capable of being pushed through the opening in the end cap by passing through the internal slots, the plate having a lateral dimension which is larger than the opening in the end cap for forming a water proof seal with the end cap but smaller than the internal dimension of the tubular shell to allow removal of the tubular shell; and a threaded nut means for engaging the threaded portion of the support structure for tightening the plate against the end cap and securing the end cap to the end of the tubular shell.

21. A method of assembling a portable work light comprising the steps of:

providing a clear tubular outer shell having a cavity extending along a longitudinal axis with an internal dimension extending transverse said axis for surrounding internal lighting components, the internal lighting components being secured to a support structure which has a threaded portion at an end thereof, a plate being connected to the support structure by internal wiring extending from the support structure;

enclosing an end of the tubular shell with a resilient end cap, the end cap having an opening passing through the end cap, the plate when disposed in a plane transverse to the longitudinal axis completely covers the opening in the end cap but when disposed in another plane is capable of being pushed through the opening in the end cap, the plate having a lateral dimension which is larger than the opening in the end cap for forming a waterproof seal with the end cap but smaller than the internal dimension of the tubular shell to allow removal of the tubular shell;

disposing the plate in a plane non-transverse to the longitudinal axis and pushing the plate through the opening in the end cap;

positioning the plate over the opening in the end cap in a plane transverse to the longitudinal axis such that the threaded portion of the structural rod extends through an opening in the plate; and engaging a threaded nut means on the threaded portion of the support structure for tightening the plate against the end cap and securing the end cap to the end of the tubular shell.

* * * * *